United States Patent [19]

Rosenberg

[11] 4,072,582

[45] Feb. 7, 1978

[54] AQUEOUS ACID PLATING BATH AND ADDITIVES FOR PRODUCING BRIGHT ELECTRODEPOSITS OF TIN

[75] Inventor: William E. Rosenberg, Strongsville, Ohio

[73] Assignee: Columbia Chemical Corporation, Cleveland, Ohio

[21] Appl. No.: 754,177

[22] Filed: Dec. 27, 1976

[51] Int. Cl.[2] ..... C25D 3/32

[52] U.S. Cl. ..... 204/54 R; 204/DIG. 2; 252/182; 260/600 R

[58] Field of Search ..... 204/54 R, 54 L, 43 S, 204/120, DIG. 2; 252/182; 260/600 R

[56] References Cited

FOREIGN PATENT DOCUMENTS 1,141,284 1/1969 United Kingdom ..... 204/54 R

*Primary Examiner*—G. L. Kaplan

*Attorney, Agent, or Firm*—Oldham, Oldham, Hudak & Weber Co.

[57] ABSTRACT

An aqueous acid tin electroplating bath contains as a brightening agent certain dialkoxy benzaldehydes, an emulsifying agent, as well as alpha, beta unsaturated carboxylic acids, amides, and esters to give extremely bright electrodeposits.

28 Claims, No Drawings

AQUEOUS ACID PLATING BATH AND ADDITIVES FOR PRODUCING BRIGHT ELECTRODEPOSITS OF TIN

BACKGROUND OF THE INVENTION

The present invention relates to an aqueous acid electroplating bath for producing extremely bright electrodeposits of tin. Additionally, the present invention relates to a brightening agent and an acid plating bath containing the brightening agent which produces brighter deposits at higher current densities and with less pitting than with previously known tin plating baths over a very broad current-density range.

In the field of tin brightening compositions for acid tin baths, various aromatic aldehydes and ketones compounds have been utilized. Generally, although many of these such compounds produce an acceptable plating, often it was difficult to avoid pitting as well as to obtain an extremely bright electrodeposit at high current densities.

Plating baths and plating additives heretofore utilized include those set forth in U.S. Pat. No. 3,808,277 to Alvarez; U.S. Pat. No. 3,755,096 to Passal; U.S. Pat. No. 3,875,029 to Rosenberg et al; and, U.S. Pat. No. 3,977,949 to Rosenberg. However, none of these plating baths or tin brighteners are pertinent to the present invention.

SUMMARY OF THE INVENTION

Accordingly, it is an object of the present invention to provide brightening agents which produce extremely bright electrodeposits of tin.

It is another object of the present invention to provide certain dialkoxy benzaldehydes as a brightening agent.

It is a further object of the present invention to provide a tin plating bath having a certain dialkoxy benzaldehyde brightening agent which acts synergistically with alpha beta unsaturated carboxylic acids, amides and esters to give extremely bright electrodeposits of tin over a broad current density range and produce low amounts of pitting.

It is yet a further object of the present invention to provide a tin plating bath, as above, wherein emulsifiers are utilized to disperse the brightening agent.

These and other objects of the present invention, together with the advantages thereof over existing prior art compounds and methods, are herein described and claimed.

In general, a primary tin plating brightener additive comprises, a dialkoxy benzaldehyde of the following general formula:

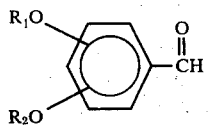

where $R_1$ and $R_2$ are methyl, ethyl, propyl and isopropyl, and wherein one alkoxy group is ortho and the other alkoxy group is meta to the carbonyl group or where both alkoxy groups are meta to said carbonyl group, and including from about 1 percent to about 97 percent by weight of at least one compound selected from the group consisting of alpha, beta unsaturated carboxylic acids, amides, and esters for producing bright electrodeposits of tin from an aqueous acid plating bath.

Additionally, the aqueous acid electroplating bath for producing electrodeposits of tin containing stannous ions and sulfuric acid comprises from about 0.005 to about 0.2 grams/liter dissolved therein of a dialkoxy benzaldehyde having the following general formula:

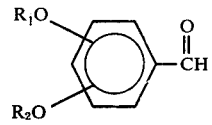

where $R_1$ and $R_2$ is methyl, ethyl, propyl and isopropyl, and where one alkoxy group is ortho to the carbonyl group and the other alkoxy group is meta to the carbonyl group, or where both alkoxy groups are meta to said carbonyl group.

DESCRIPTION OF THE PREFERRED EMBODIMENTS

According to the concepts of the present invention, it has been found that very bright electrodeposits with little pitting can be obtained from an aqueous acid tin plating bath when certain dialkoxy benzaldehydes are used as primary brighteners. It has also been found that these dialkoxy benzaldehydes act synergistically with alpha, beta unsaturated carboxylic acids, amides and esters to produce extremely bright electrodeposits. The effect is truly synergistic in that the results obtained with this combination far exceeded those of using the two types of compounds separately.

The dialkoxy benzaldehydes of the present invention have the following general formula:

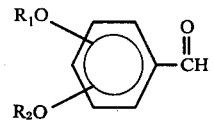

where $R_1$ and $R_2$ are methyl, ethyl, propyl, and isopropyl, and where one alkoxy group is ortho and the other alkoxy group is meta to the carbonyl group or both alkoxy groups are meta to the carbonyl group. $R_1$ and $R_2$, as methyl groups, are preferred. The dialkoxy benzaldehydes are generally used at a concentration of about 0.005 to 0.2 grams/liter of plating bath and the preferred concentration is about 0.01 to about 0.05 grams/liter. They may be added to the bath in concentrated form or as dilute solutions in various suitable solvents such as methanol and ethanol. Preferred dialkoxy benzaldehydes include 3,5-dimethoxy benzaldehyde, 2,5-dimethoxy benzaldehyde, and 2,3-dimethoxy benzaldehyde. The benzaldehyde compounds containing one alkoxy group at the para position are not part of the present invention since, for some reason, they produce very poor results.

Many of the various dialkoxy benzaldehyde compounds of the present invention are readily available in commerce. Moreover, they can be readily prepared by one skilled in the art such as through alkylation of the corresponding dihydroxy toluene followed by oxidation to the aldehyde.

Since the dialkoxy benzaldehydes exhibit limited solubility in the plating bath, emulsifying agents generally must be used to disperse them. A brightener additive mixture may therefore contain the dialkoxy benzaldehyde and from about 1 percent to about 96 percent by weight of the emulsifying agent based upon the total weight of only these two components. The types of emulsifiers or wetting agents that have been found to work quite well are listed in Table I. Depending upon the emulsifying ability of the particular emulsifying agent used, an amount in the range of about 2 to 40 grams/liter of plating bath is generally sufficient.

TABLE I

| TRADE NAME | TYPE | MANUFACTURER |
|---|---|---|
| Igepal CO-730 | Nonionic | GAF |
| Tergitol 08 | Anionic | Union Carbide |
| Miranol HS | Amphoteric | Miranol Chemical Co. |
| Amine C | Cationic | Ciba-Geigy |
| Tergitol TMN | Nonionic | Union Carbide |
| Avirol 100-E | Anionic | Standard Chemical Prod., Inc. |
| Tetronic 702 | Nonionic | BASF-Wyandotte |

The preferred emulsifying agents have been found to be the nonionics made by condensing ethylene oxide with lipophilic groups such as long chain fatty alcohols, long chain fatty amines, long chain fatty acids, and long chain alkylphenols, the long chain containing from 6 to 30 and preferably from 6 to about 20 carbon atoms. The optimum amount of ethylene oxide is about 10 to 30 moles per mole of lipophile. While these are the highly preferred nonionics, it is not meant to limit the invention to these types only. For example, ethylene oxide derivatives of naphthols and polysaccharides also perform satisfactorily. In addition, propylene oxide condensates and ethylene oxide-propylene oxide block copolymers are considered part of the invention.

Generally, any alpha-beta unsaturated carboxylic acids, amides, and esters may be utilized with the brightener to form the synergistic increase in the production of extremely bright electrodeposits of tin which have very little pitting.

Preferred alpha, beta unsaturated carboxylic acids, amides and esters are listed in Table II.

TABLE II

Acrylic acid
Acrylamide
Methyl acrylate
Methacrylic Acid
Methacrylamide
Methylmethacrylate
Crotonic Acid The alpha, beta unsaturated compounds are generally added as aqueous or alcoholic (e.g. methyl, ethyl, propyl, isopropyl alcohol) solutions to insure good dispersion in the plating bath. The alpha, beta unsaturated compounds are used in a concentration of about 0.02 to about 5 grams/liter of bath and the preferred concentration is about 0.2 to about 2 grams/liter. These compounds may also be a part of a brightener agent mixture containing the dialkoxy benzaldehyde and from about 1 to about 97 percent by weight of the alpha, beta unsaturated carboxylic acids, amides, and esters of the two component mixture (i.e. brightener and unsaturated compound). Of course, an emulsifying agent may also be added to this mixture wherein the amount of emulsifying agent ranges from about 1 to 96 percent by weight based upon the total weight of the three component mixture (i.e. brightener the unsaturated compound, and the emulsifying agent exclusive of any solvent). A preferred mixture of the present invention contains all of the three noted components.

Conventional addition agents konwn to the art such as aromatic and aliphatic ketones and aldehydes may be used in conjunction with this invention, if desired. However, such compounds generally do not affect the brightness of the electrodeposit.

While the brightening agents of this invention are effective in many aqueous acid tin plating bath formulations, it is preferred to use any of the basic baths described in the following examples. In general, a source of stannous ions such as stannous sulfate, is present. A suitable amount is from about 10 to about 100 grams/liter. Also present is sulfuric acid. A suitable amount is from about 75 to about 260 grams/liter.

EXAMPLE I

| BATH COMPOSITION | CONCENTRATION IN GRAMS/LITER |
|---|---|
| Stannous Sulfate | 35 |
| Sulfuric Acid | 150 |
| 3,5-dimethoxy benzaldehyde | 0.1 |
| Methacrylamide | 0.15 |
| Igepal CO-730 | 5 |

EXAMPLE II

| BATH COMPOSITION | CONCENTRATION IN GRAMS/LITER |
|---|---|
| Stannous Sulfate | 30 |
| Sulfuric Acid | 180 |
| 2,5-dimethoxy benzaldehyde | 0.04 |
| Acrylic Acid | 0.4 |
| Tergitol TMN | 11 |

EXAMPLE III

| BATH COMPOSITION | CONCENTRATION IN GRAMS/LITER |
|---|---|
| Stannous Sulfate | 30 |
| Sulfuric Acid | 180 |
| 3,5-dimethoxy benzaldehyde | 0.075 |
| Methacrylic Acid | 0.5 |
| Igepal CO-730 | 5 |

EXAMPLE IV

| BATH COMPOSITION | CONCENTRATION IN GRAMS/LITER |
|---|---|
| Stannous Sulfate | 30 |
| Sulfuric Acid | 180 |
| 2,3-dimethoxy benzaldehyde | 0.04 |
| Methacrylic Acid | 0.6 |
| Tetronic 702 | 4 |
| Miranol HS | 7.5 |

All testing was done in a conventional 267 ml. Hull Cell, using steel cathode panels and tin anodes. A current of 2 amperes was used for five minutes at temperatures ranging from 70° C to 85° F. The results of tests using Examples I through IV, along with several variations, are discussed in Table III.

TABLE III

| BATH COMPOSITION | RESULTS |
|---|---|
| Bath of Example I | Bright from about 1 amp per square foot to well over 120 amps per square foot. |
| Bath of Example II | Bright to extremely bright from about 0 amps per square foot to well over 120 amps per square foot. |
| Bath of Example III | Bright from 2 to well over 120 amps per square foot and semi-bright from 0 to 2 amps per square foot. |
| Bath of Example IV | Bright from 0 to well over 120 amps per square foot. |
| Bath of Example IV, but without | Dull to semi-bright from 1 to 90 amps per square foot. |

TABLE III-continued

| BATH COMPOSITION | RESULTS |
|---|---|
| the alpha, beta unsaturated compound | Very dull over 90 amps per square foot. |
| Bath of Example IV, but without the dialkoxy benzaldehyde | Semi-bright from 60 to 90 amps per square foot. Extremely dull, below 60 amps per square foot. |

Having thus described this invention in such full, clear, concise, and exact terms as to enable any person skilled in the art to which it pertains to make and use the same, and having set forth the best mode contemplated of carrying out this invention in accordance with the patent statutes, the subject matter which is regarded as being my invention is particularly pointed out and distinctly claimed in the appended claims.

What is claimed is:

1. A primary tin electroplating brightener additive, comprising;

a dialkoxy benzaldehyde having the general formula:

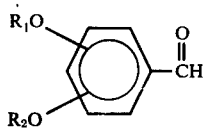

where $R_1$ and $R_2$ are methyl, ethyl, propyl or isopropyl, and where one alkoxy group is ortho and the other alkoxy group is meta to the carbonyl group or where both alkoxy groups are meta to the carbonyl group, and from about 1 to about 97 percent by weight of at least one compound selected from the class consisting of alpha, beta unsaturated carboxylic acids, amides, and esters for producing bright electrodeposits of tin from an aqueous acid plating bath.

2. The additive according to claim 1 including from 1 to about 96 percent of at least one emulsifying agent selected from the group consisting of nonionic, cationic, anionic, and amphoteric emulsifying agents.

3. The additive according to claim 2, wherein the emulsifying agent is a nonionic emulsifying agent.

4. The additive according to claim 3, wherein $R_1$ and $R_2$ are methyl.

5. The additive according to claim 2, wherein $R_1$ and $R_2$ are methyl.

6. The additive according to claim 1, wherein $R_1$ and $R_2$ are methyl.

7. The additive according to claim 1, wherein said alpha, beta unsaturated compounds are selected from the group consisting of acrylic acid, acrylamide, methyl acrylate, methacrylic acid, methacrylamide, methyl methacrylate, and crotonic acid.

8. The additive according to claim 7, wherein said alpha, beta unsaturated compounds are selected from the class consisting of acrylic acid and methacrylic acid.

9. The additive according to claim 8, wherein one alkoxy group is ortho and the other alkoxy group is meta to the carbonyl group.

10. The additive according to claim 9, wherein $R_1$ and $R_2$ are methyl.

11. The additive according to claim 10, including a nonionic emulsifying agent, said nonionic emulsifying agent made by condensing ethylene oxide with a lipophilic group, said lipophilic group selected from the class consisting of a long chain fatty alcohol, a long chain fatty amine, a long chain fatty acid, and a long chain alkylphenol, said long chain containing from 6 to 30 carbon atoms, and wherein from about 10 to about 30 moles of said ethylene oxide are used per mole of said lipophilic group.

12. The additive according to claim 8, wherein the alkoxy groups are both meta to the carbonyl group.

13. The additive according to claim 12, wherein $R_1$ and $R_2$ are methyl.

14. The additive according to claim 13, including a nonionic emulsifying agent, said nonionic emulsifying agent made by condensing ethylene oxide with a lipophilic group, said lipophilic group selected from the class consisting of a long chain fatty alcohol, a long chain fatty amine, a long chain fatty acid, and a long chain alkylphenol, said long chain containing from 6 to 30 carbon atoms, and wherein from about 10 to about 30 moles of said ethylene oxide are used per mole of said lipophilic group.

15. An aqueous acid electroplating bath containing stannous ions and sulfuric acid for producing bright electrodeposits of tin, comprising;

from about 0.005 to about 0.2 grams/liter of a dialkoxy benzaldehyde brightener dissolved in the bath, said brightener having the general formula:

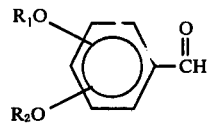

where $R_1$ and $R_2$ is methyl, ethyl, propyl, or isopropyl, and where one alkoxy group is ortho and the other alkoxy group is meta to the carbonyl group or where both alkoxy groups are meta to the carbonyl group.

16. The bath according to claim 15, wherein about 2 to about 40 grams/liter of an emulsifying agent is added to solubolize said dialkoxy benzaldehyde, said emulsifying agent is selected from the class consisting of nonionic, anionic, cationic, and amphoteric emulsifying agents.

17. The bath according to claim 16, having dissolved therein about 0.02 to about 5 grams/liter of at least one compound from the group consisting of alpha, beta unsaturated carboxylic acids, amides, and esters.

18. The bath according to claim 17, wherein said alpha, beta unsaturated compounds are selected from the class consisting of acrylic acid, acrylamide, methyl acrylate, methacrylic acid, methacrylamide, methylmethacrylate, and crotonic acid.

19. The bath according to claim 18, wherein said alpha, beta unsaturated compound is selected from the class consisting of acrylic acid and methacrylic acid.

20. The bath according to claim 19, wherein said emulsifying agent is a nonionic emulsifying agent.

21. The bath according to claim 20, wherein said nonionic emulsifying agent is an alkylphenol condensed with 10 to 30 moles of ethylene oxide per mole of alkyl phenol.

22. The bath according to claim 21, wherein $R_1$ and $R_2$ are methyl.

23. The bath according to claim 20, wherein $R_1$ and $R_2$ are methyl.

24. The bath according to claim 23, wherein one alkoxy group is ortho and one alkoxy group is meta to the carbonyl group.

25. The bath according to claim 23, wherein both alkoxy groups are meta to the carbonyl group.

26. The bath according to claim 18, wherein said emulsifying agent is a nonionic emulsifying agent.

27. The bath according to claim 26, wherein $R_1$ and $R_2$ are methyl.

28. The bath according to claim 18, wherein $R_1$ and $R_2$ are methyl.

* * * * *